US009328982B2

(12) United States Patent
Ladner

(10) Patent No.: US 9,328,982 B2
(45) Date of Patent: May 3, 2016

(54) SYSTEMS AND METHODS FOR LIMITING CAPACITY OF FIREARM MAGAZINES

(76) Inventor: Zachary Daniel Ladner, Pleasant Hill, CA (US)

( * ) Notice: Subject to any disclaimer, the term of this patent is extended or adjusted under 35 U.S.C. 154(b) by 0 days.

(21) Appl. No.: 13/429,301

(22) Filed: Mar. 23, 2012

(65) Prior Publication Data

US 2012/0246988 A1 Oct. 4, 2012

Related U.S. Application Data

(60) Provisional application No. 61/468,072, filed on Mar. 28, 2011.

(51) Int. Cl.
*F41A 9/71* (2006.01)

(52) U.S. Cl.
CPC ..... *F41A 9/71* (2013.01)

(58) Field of Classification Search
CPC ..... F41A 9/71
USPC ..... 42/1.01, 1.02, 7, 18, 49.01, 49.02, 50
See application file for complete search history.

(56) References Cited

U.S. PATENT DOCUMENTS

| | | | | |
|---|---|---|---|---|
| 2,026,252 | A * | 12/1935 | Russell et al. | 42/49.01 |
| 2,635,378 | A | 4/1953 | Pinckney et al. | |
| 3,371,440 | A * | 3/1968 | Cassell | 42/49.02 |
| 3,777,383 | A | 12/1973 | Haines et al. | |
| 3,913,251 | A | 10/1975 | Browning | |
| 4,139,959 | A | 2/1979 | Howard et al. | |
| 5,113,605 | A * | 5/1992 | Kim | 42/50 |
| 5,507,110 | A | 4/1996 | Chesnut et al. | |
| 5,568,696 | A | 10/1996 | Mauch et al. | |
| 5,568,698 | A * | 10/1996 | Harding et al. | 43/53.5 |
| 5,638,626 | A | 6/1997 | Westrom | |
| 5,704,148 | A * | 1/1998 | Valorose | 42/50 |
| 5,845,426 | A | 12/1998 | Valorose | |
| 8,061,071 | B2 † | 11/2011 | Fitzpatrick et al. | |
| 2011/0005113 | A1 | 1/2011 | Fitzpatrick et al. | |
| 2011/0030259 | A1 * | 2/2011 | Castro et al. | 42/6 |
| 2013/0192115 | A1 * | 8/2013 | Calilung | 42/49.01 |

FOREIGN PATENT DOCUMENTS

WO WO 2008132739 A2 * 11/2008 ..... F41A 9/62

OTHER PUBLICATIONS

Calguns.net forum thread entitled "Why epoxy magazine blocks". p. 1. Jan. 14, 2010. <http://www.calguns.net/calgunforum/showthread.php?t=259201>.*

(Continued)

*Primary Examiner* — Gabriel Klein
(74) *Attorney, Agent, or Firm* — Kang S. Lim

(57) ABSTRACT

The present invention relates to systems and methods for reliably limiting the cartridge loading capacity of firearm magazines. In one embodiment, a magazine capacity limiting assembly includes a limiter body and a limiter base. The magazine capacity limiter body reliably operates with a cartridge follower of a firearm magazine. The limiter body is installed substantially within coils of the magazine's spring, thereby limiting the travel of the follower within the magazine body to limit the magazine's cartridge capacity. The limiter base is coupled to both the limiter body and the magazine's floor plate.

15 Claims, 6 Drawing Sheets

(56) References Cited

OTHER PUBLICATIONS

Calguns.net forum thread entitled "Why epoxy magazine blocks". p. 2. Jan. 14, 2010. <http://www.calguns.net/calgunforum/showthread.php?t=259201&p.=2>.*

AR15.com forum thread by user "fletchnuts" titled Turn a 20 Round PMAG into a 5 Round Hunting Mag (w/PICS!!!!), Apr. 4, 2009, http://www.ar15.com/forums/t_3_17/426869_DIY_MOD___Turn_a_20_Round_PMAG_into_a_5_Round_Hunting_Mag___w_PICS___.html.† shotgunworld orum thread by user "Seamus O'Caiside" titled "Disassembly of Baretta 391", Feb. 26, 2007 http://www.shotgunworld.com/bbs/viewtopic.php?t=101242.†

* cited by examiner
† cited by third party

SYSTEMS AND METHODS FOR LIMITING CAPACITY OF FIREARM MAGAZINES

CROSS REFERENCE TO RELATED APPLICATIONS

This non-provisional application claims the priority of Provisional Application Ser. No. 61/468,072 filed on Mar. 28, 2011 entitled "Magazine Capacity Limiter", which application is incorporated herein in its entirety by this reference.

BACKGROUND

To achieve the foregoing and in accordance with the present invention, systems and methods for limiting firearm ammunition capacity are provided. In particular, the systems and methods limit the cartridge capacity of detachable firearm magazines without compromising reliability.

Firearms and firearm accessories have steadily evolved over time, resulting in increased functionality and flexibility over time. Today, there is a variety of firearm modifications and/or accessories commercially available to accommodate a wide range of users' needs. Occasionally, innovation in the firearms industry is also driven by legislative trends, as firearm owners are required to respond by limiting the functionality of their firearms and/or accessories, for example, limiting the ammunition capacity of semi-automatic firearm magazines.

In response to political pressures, Federal and State laws have been enacted to limit features of semi-automatic firearms and also the capacity of firearm magazines. For example, in some jurisdictions, the use of detachable magazines with semi-automatic rifles is strictly regulated. To comply, detachable magazines sold in those jurisdictions must either be designed to or be altered to only accept a limited number of cartridges, e.g. ten rounds.

Prior inferior attempts at limiting magazine capacity include installing a rivet in the side of the magazine to limit the downward travel of the follower. This involves exterior modification of the magazine body and involves substantial trial and error to find the correct position of said rivet. Another prior method involves installing a large block under the bottom of the magazine spring and substantially filling up the bottom space of the magazine body. This method is not desirable because the installation of the block increases spring tension and wear. Alternatively, different magazine bodies can be retrofitted with different replacement springs, but that fails to provide a more generic solution.

Other attempts include modifications to the magazine followers, which is not desirable because the magazine follower is a critical component of the magazine and directly affects the magazine's reliability and functionality. For example, many magazine followers include anti-tilt features to increase magazine reliability and prevent malfunctions, and modifications to these followers are likely to adversely affect the magazine reliability.

In some of the more restrictive jurisdictions, magazine limiting modifications have to be considered "permanent" to be considered fully compliant legally. A common practice is to epoxy or roll pin the magazine body permanently closed. However, such drastic modifications do not allow the magazines to be reconfigured back to their original "higher capacity" configuration when used in other more liberal jurisdictions where these restrictions do not exist.

It is therefore apparent that an urgent need exists for improved cost-effective capacity-limiting assemblies for cost-effectively modifying higher-capacity magazines to comply with applicable laws and regulations, as needed, without compromising reliability. These improved capacity-limiting assemblies should enable users to quickly and efficiently limit the capacity of the magazines.

SUMMARY

To achieve the foregoing and in accordance with the present invention, systems and methods for limiting firearm ammunition capacity are provided. In particular, these systems and methods limit the cartridge capacity of detachable firearm magazines without adversely affecting reliability.

In one embodiment, a magazine capacity limiting assembly is configured to limit the cartridge capacity of a firearm magazine having a magazine body, a cartridge follower, a magazine spring and a magazine floor plate. This limiting assembly includes a magazine capacity limiter body and a magazine capacity limiter base. The magazine capacity limiter body includes a top edge configured to operate with the cartridge follower. The limiter body is installed substantially within coils of a magazine spring, thereby limiting the travel of the magazine follower within the magazine body to limit the magazine's cartridge capacity. The magazine capacity limiter base is operatively coupled to both the magazine limiter body and the magazine floor plate.

In some embodiments, the capacity limiter body includes an upper limiter and a lower limiter, wherein the upper limiter is configured to be detachable from the lower limiter, thereby changing the cartridge capacity of the firearm magazine. Alternatively, the upper limiter and the lower limiter can be configured to be adjustably secured to each other resulting in at least two overall heights of the limiter body, thereby varying the cartridge capacity of the firearm magazine. In this embodiment, the upper limiter and the lower limiter each include corresponding ribbed surfaces configured to operatively engage each other resulting in the at least two overall heights of the limiter body.

Many modifications and additions are also possible. For example, the capacity limiter body can include one or more protruding magazine spring locks configured to securely couple the bottom of the magazine spring to the limiter body. A clearance gap can be intentionally created between the magazine follower and the top of the limiter body, thereby enabling the firearm magazine to function reliably with a firearm without changing the cartridge capacity of the firearm magazine and without permitting an extra cartridge to be loaded into the firearm magazine.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which:

FIGS. 2A and 2B are side views illustrating two alternate configurations of one embodiment of a magazine capacity limiting assembly in accordance with the present invention, while

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Figure 1:
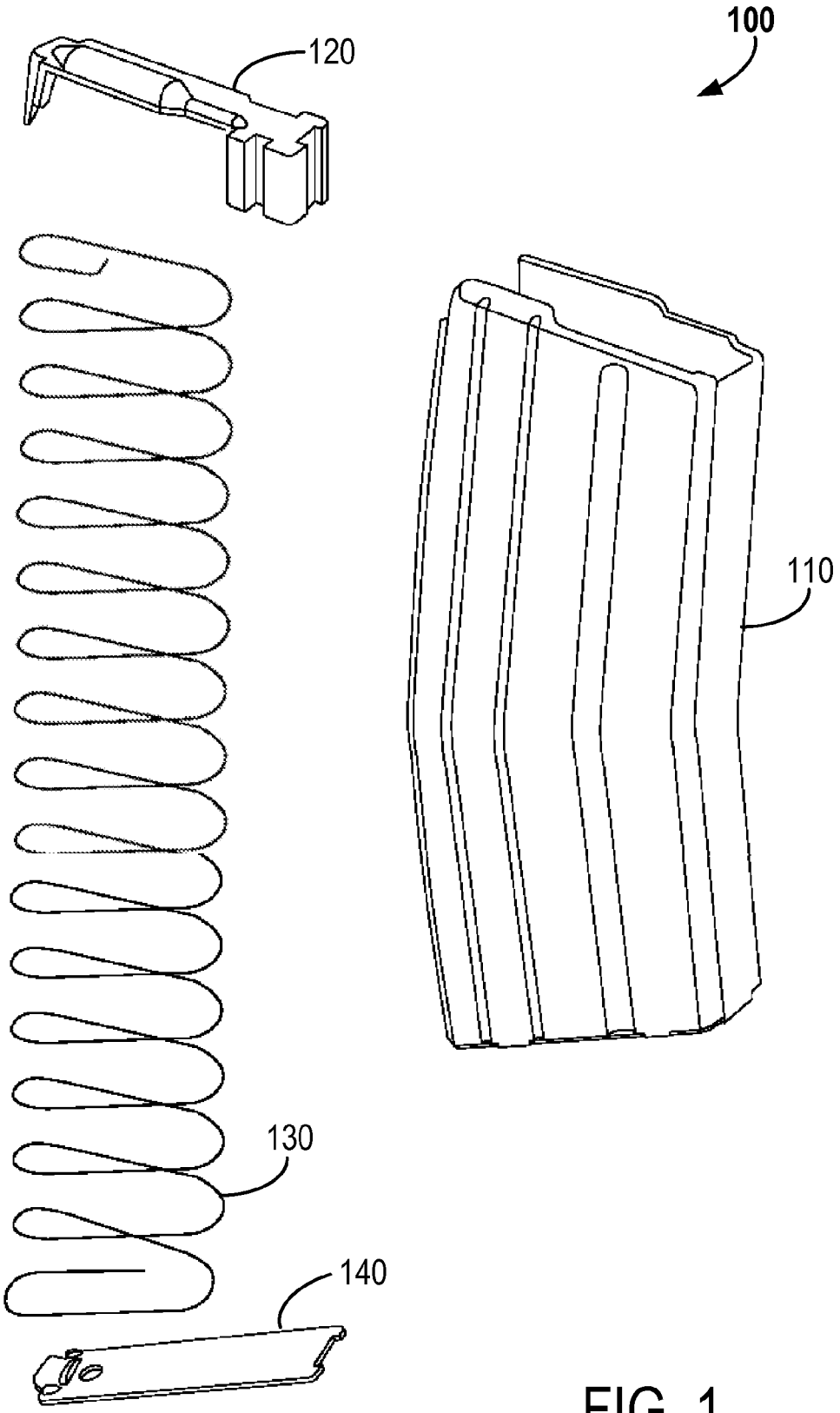
FIG. 1 is an exploded view showing the components of an exemplary high-capacity firearm magazine.

The present invention relates to systems and methods for limiting firearm ammunition capacity are provided. In particular, the systems and methods for limiting the cartridge capacity of detachable firearm magazines. Referring first to FIG. 1, an exploded view of an exemplary detachable high-capacity ("high-cap") firearm magazine, magazine 100 includes a magazine body 110, a magazine follower 120, a magazine spring 130 and a magazine floor plate 140. Assembly of high-cap magazine 100 is accomplished by first inserting the top of the magazine follower 120 into the bottom the magazine body 110. Next, the magazine spring 130 is inserted from the bottom of the magazine body 110 and in contact with the bottom of the magazine follower 120. The magazine spring 130 is then compressed to be flushed with the bottom edge of the magazine body 110. The magazine floor plate 140 can now secured to the bottom of the magazine body 110, thereby completing the assembly process for high-cap magazine 100.

Figure 2A:
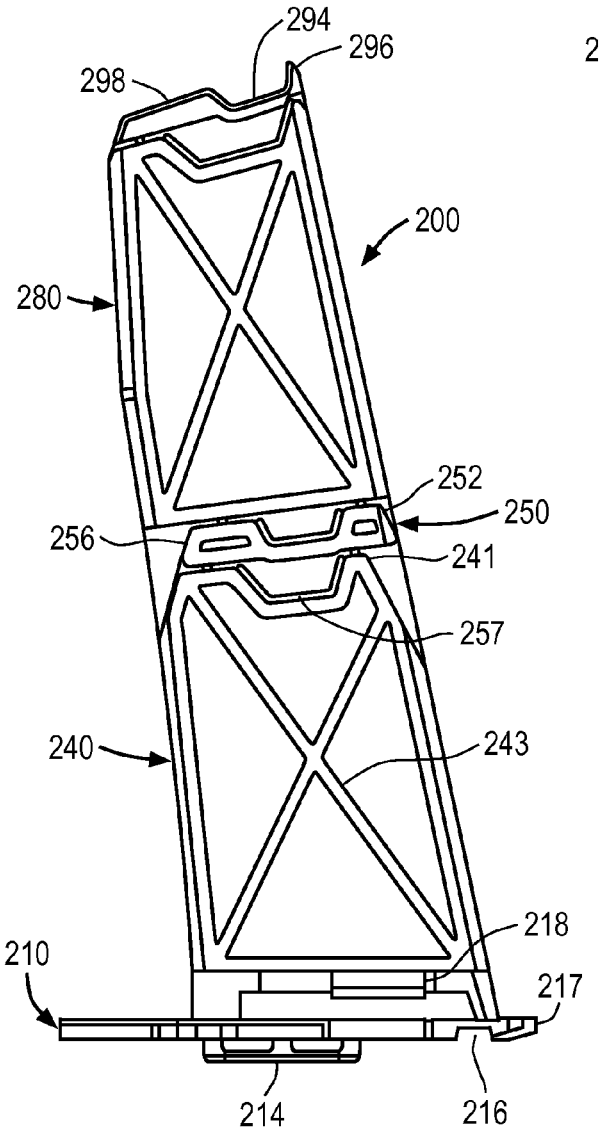
Figure 2C:
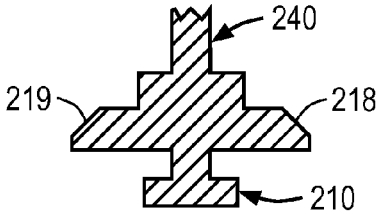
FIG. 2C is a partial cross-sectional view 2C-2C of the limiting assembly of FIG. 2B.
Figure 2B:
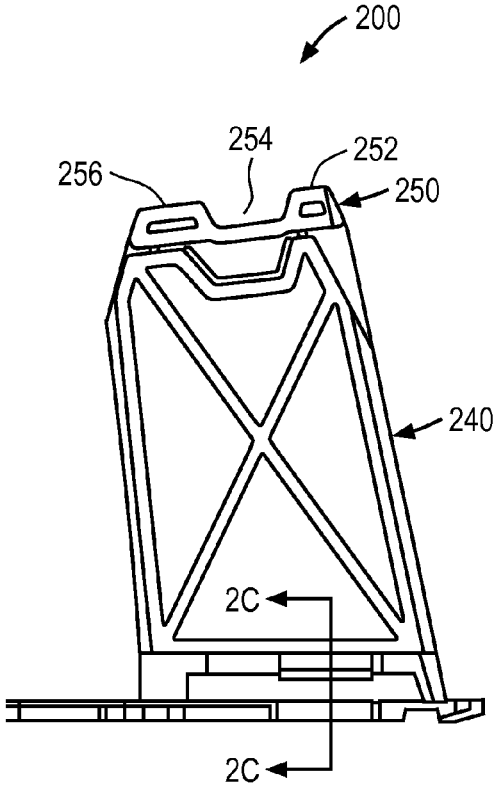

To facilitate discussion, FIGS. 2A and 2B show side views illustrating alternate configurations of one embodiment of a magazine capacity limiting assembly 200 in accordance with the present invention. FIG. 2C is a partial cross-sectional view 2C-2C of the lower portion of limiter assembly 200. Assembly 200 can be configured and incorporated into high-cap magazines, e.g., high-cap magazine 100, thereby limiting the number of firearm cartridges, e.g., ten cartridges, which can be loaded into these magazines.

As shown in FIG. 2A, capacity limiting assembly 200 includes a magazine locking plate 210, a lower limiter 240, an intermediate limiter 250, and an upper limiter 280. In this embodiment, an optional floor plate lock 214 may be operatively coupled to the locking plate 210. Optional floor plate lock 214 is intended to be compatible with aftermarket magazine floor plates having a corresponding mating recess such as Magpul™ "Ranger" and "L" floor plates, available from Magpul Industries Corporation, Boulder, Colo.

The locking plate 210 may include indentation(s) 216 enabling locking plate 210 to be retained by a floor plate attached to the magazine 100 and enabling the locking plate 210 to sit flush against the bottom of the magazine 100. In addition, the magazine spring 130 can be retained and held in place by a spring lock 218 and a corresponding spring lock 219 protruding outwards from opposite sides of lower limiter 240. Protruding spring locks 218, 219 may be chamfered to allow downward movement of the bottom of the magazine spring 130 to engage the lock 218 during installation, but prevent the spring 130 from easily or unintentionally being detached from lower limiter 240. A recess in the upper surface 294 engages a spring attachment point of the magazine follower 120. Upon completion of installation, the downward force of the spring 130 secures the bottom of spring 130 to limiter 240. One or more optional snap locks (not shown) may also be added to further secure the bottom of the magazine spring 130 to limiter 240. Alternatively, instead of spring locks 218, 219, one or more holes may be drilled in lower limiter 240 to accept and secure the bottom of magazine spring 130. Additionally, adhesives such as epoxy can also be used to permanently secure spring 130 to limiter 240.

Note that alternative upper surfaces 241, 252/256, 298 of limiters 240, 250, 280, respectively, are molded into the limiter assembly 200. Accordingly, the overall height of limiting assembly 200 can be reduced by severing at these predetermined locations, thereby varying the cartridge capacity of magazine 100 as needed, as illustrated by the alternate configuration shown in FIG. 2B.

Capacity limiting assembly 200 can include reinforcement structures, e.g., cross rib 243, to increase structural integrity and reduce weight and material used for manufacturing. Furthermore, reinforcement structures 257, 256 are designed so that they can be easily removed when the limiting assembly 200 is reconfigured into, for example, the alternate configuration of FIG. 2B.

Figure 3:
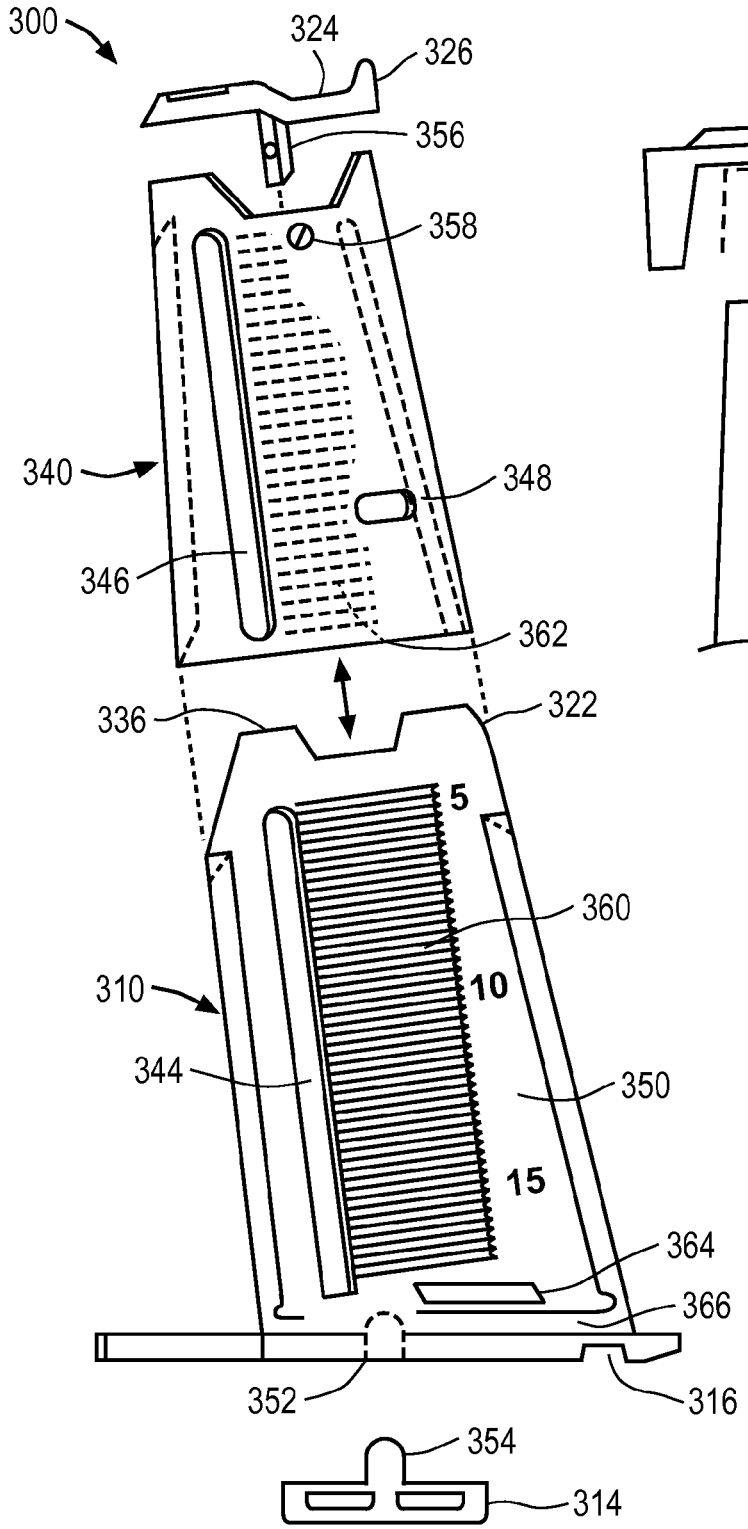
FIG. 3 is a side view of another embodiment of a magazine capacity limiting assembly.
Figure 4:
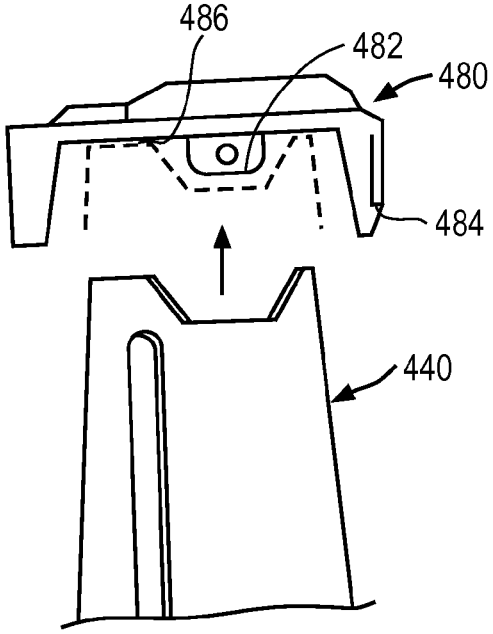
FIG. 4 illustrates the operation of the top of the magazine capacity limiting assemblies in relation to a magazine follower of a firearm magazine.

FIGS. 3 and 4 illustrate another embodiment of a limiting assembly 300 in which the height of an upper limiter 340 can be varied in relation to a lower limiter 310, thereby changing the overall height of limiting assembly 300. This can be accomplishes by use of adjustment slots 344, 346 of limiters 310, 340, respectively, and a screw and nut (not shown). A ribbed surface 360 on a face of lower limiter 310 is configured to be operatively engaged to a matching ribbed surface 362 on a corresponding face of the upper limiter 340.

A window 348 of upper limiter 340 display markings 350 allowing easy adjustments to predetermined magazine cartridge capacity settings of limiting assembly 300. These capacity settings are intended to correspond with different magazine variants and/or cartridge capacities.

Depending on specific configuration of the magazine followers, e.g. magazine follower 120 or 480, the upper mating surface 326 can be removed and replaced with a variety of alternative attachments via, for example, a post 356 secured to upper limiter 340 by a fastener such as a set screw 358. As shown in FIG. 4, such an arrangement also permits adaptations of lateral positioning of the upper surface recess 294 which is necessary for the different lower mating surfaces 486 of the magazine follower 480 and its spring attachment point 482.

Similarly, as discussed above for limiting assembly 200, to increase adaptability of limiting assembly 300 to a wide variety of magazine floor plates, alternative floor plate locks 314 can be added or removed via, for example, a post 354 and socket 352 arrangement.

Figure 5:
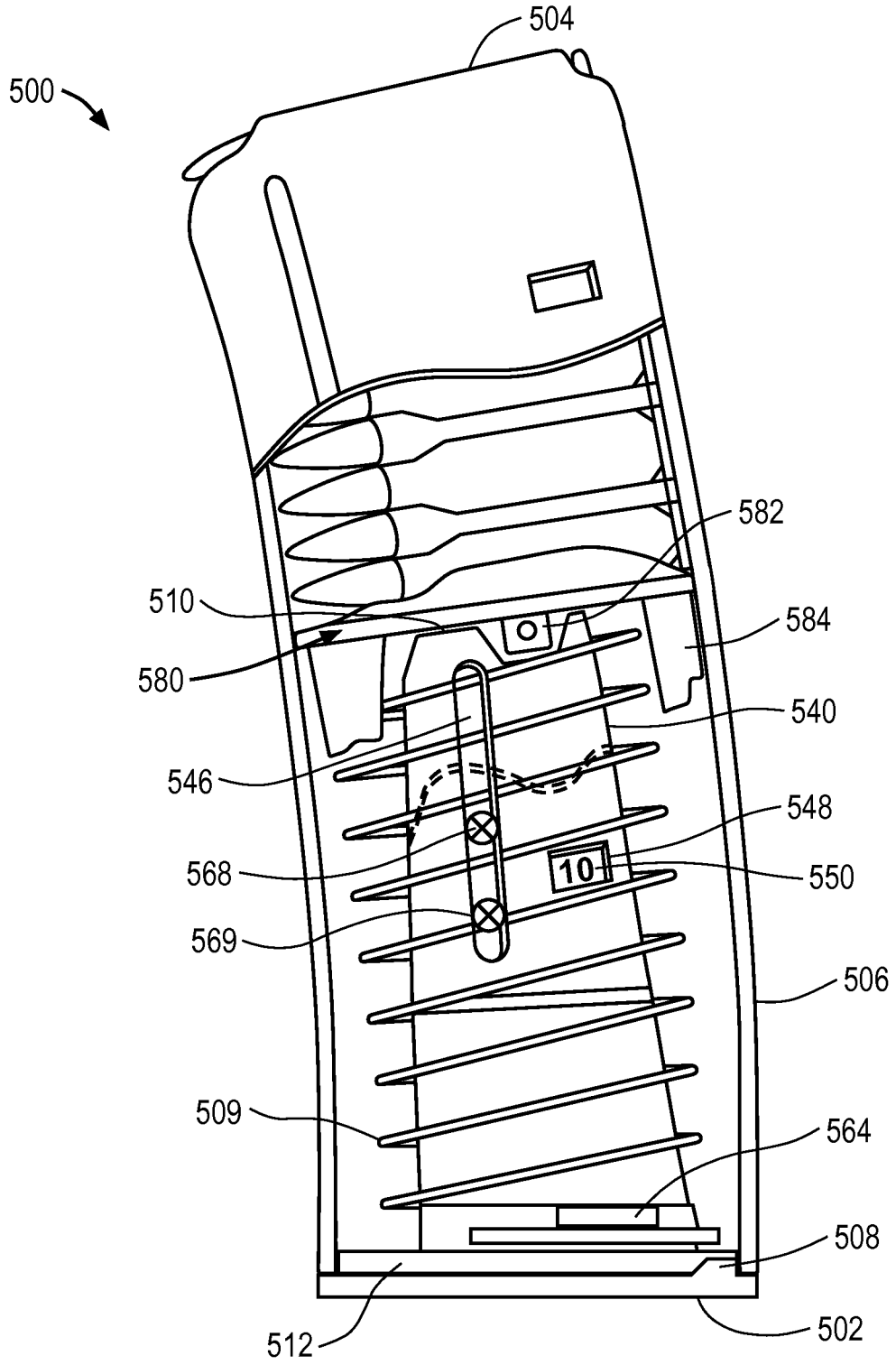
FIG. 5 is a perspective view illustrating a magazine, partially sectioned, with a magazine capacity limiting assembly of the present invention installed.

Referring now to FIG. 5, a cut-away view, one embodiment of an exemplary cartridge magazine 500 is loaded with a plurality of bottle-nose cartridges, e.g., a 5.56 mm cartridge magazine. Note that in this embodiment, configurable capacity limiting assembly 300 has been installed in magazine 500. Accordingly, the distance from the upper magazine lip surface 504 to the upper surface of the magazine follower 580, corresponding to the cartridge capacity of magazine 500, is limited now by assembly 300.

The limiting assembly 300 is configured to be installed within the coils of the magazine spring 509. The dimensions of the magazine walls 506 will determine the size and shape of the locking plate 512. The profile and size of the locking plate 210 may also be shaped to fit similar magazines without, or with minor modification(s). Further, a reliability-enhancing clearance gap 510 may be added to accommodate the loading of the rifle with a closed bolt or action and/or with dust covers. This clearance gap 510 is large enough to allow downward travel of the magazine follower 580 for these functions, but not large enough to permit an additional unwanted cartridge to be loaded into magazine 500.

The locking plate 512 is configured to be installed flush against the magazine floor plate 502 and to engage locking indentations 508 of the floor plate 502. The magazine spring 509 is attached to the upper magazine follower 580 at its intended attachment point 582 and also under the locking lug 564 of assembly 300. A permanent attachment may be made between limiting assembly 300 and magazine 500 to comply with applicable laws, regulations and ordinances, which may specify that a "permanent" alteration of the magazine 500 is required. As illustrated by FIG. 5, the upper limiter 540 may include a profile necessary to allow clearance of the downward protrusions 584 of the lower surfaces of magazine follower 580. The adjustment slot 346 is shown locked in place by the set screw(s) 568 at a position corresponding to, for example, ten cartridges or five cartridges (per hunting regulations), as seen through the magazine capacity window 548.

Figure 6:
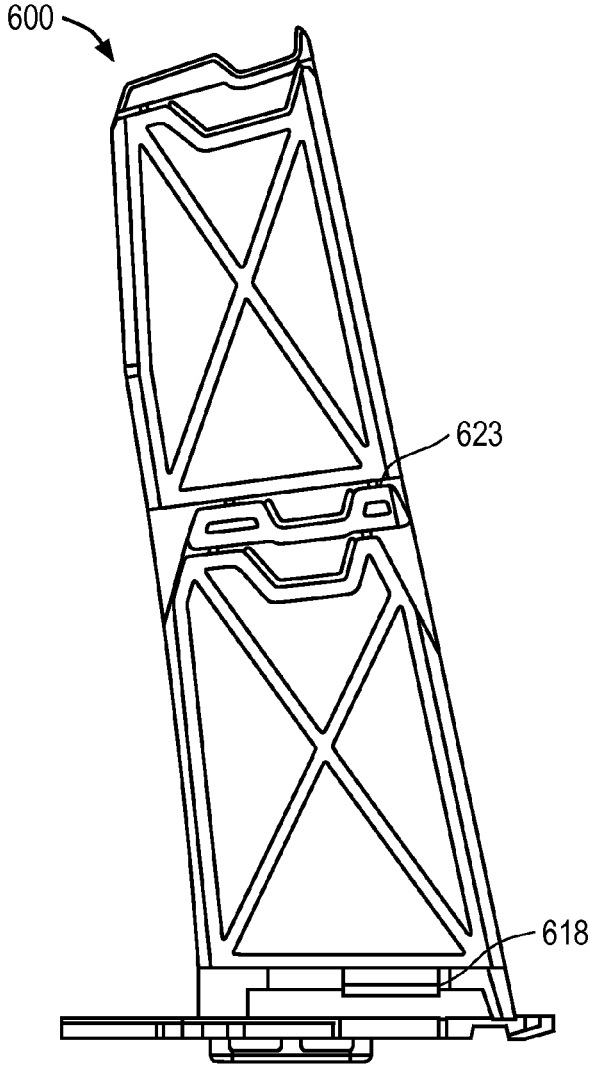
FIGS. 6 and 7 illustrate two alternate embodiments of a magazine capacity limiting assembly.
Figure 7:
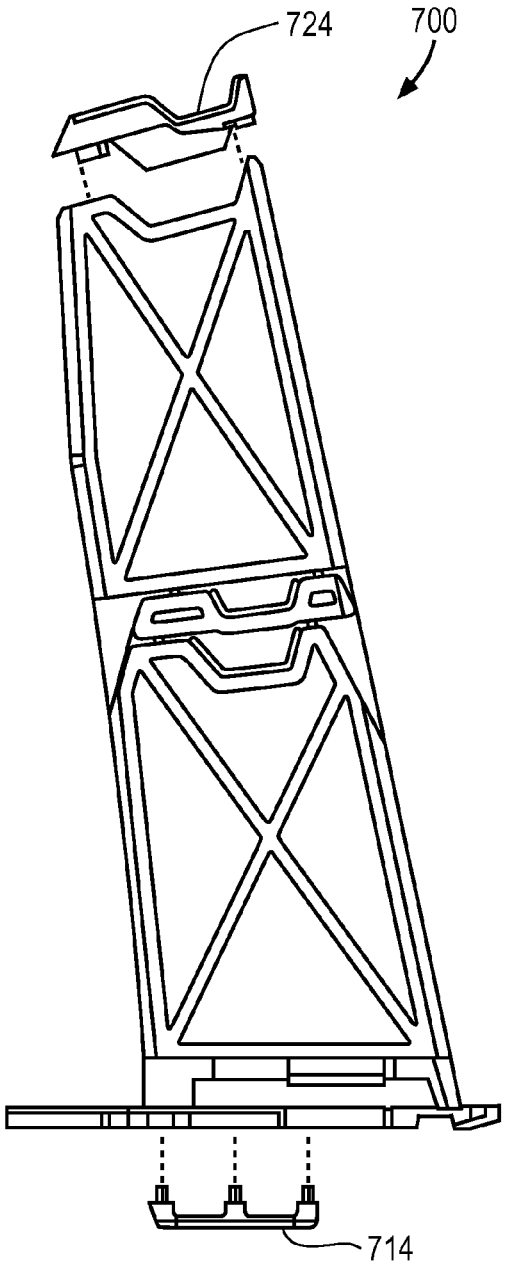

Many modifications and enhancements to the described embodiments are also possible. For example, the side view of FIG. 6 shows structural support rib(s) 623 bracing the area through which a cut can be made to easily and reliably configure an alternate configuration. These support structure(s) provide flexural strength, while enabling ease of configuring predetermined sizes. In addition, FIG. 7 illustrates an alternate method of changing the upper recess 724 location, and the removal of the locking plate lock 714.

Figure 8:
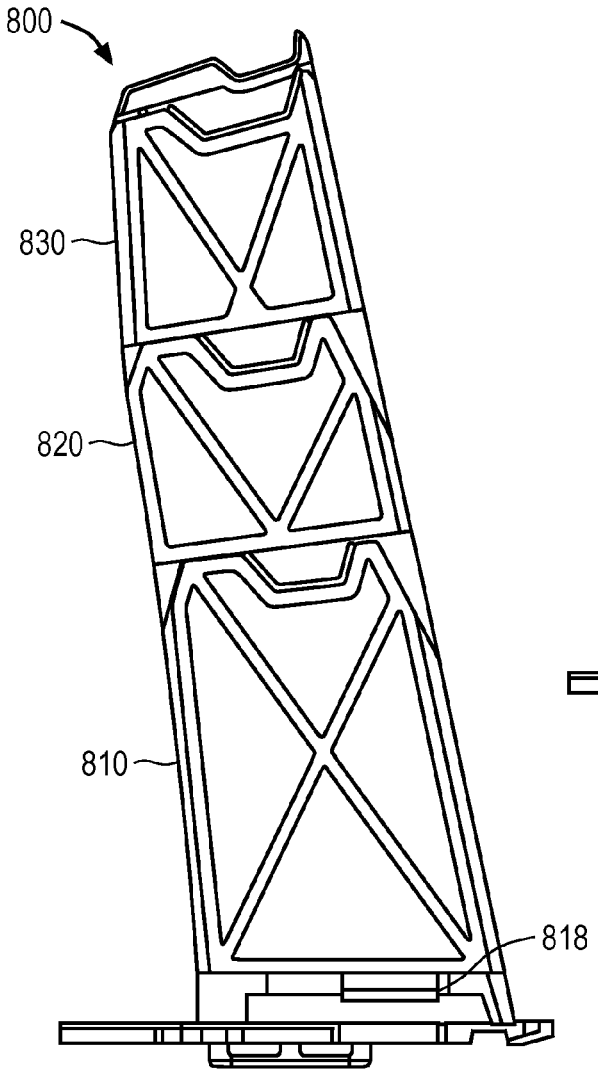
FIG. 8 is a side view of another embodiment of a capacity limiting assembly having an upper limiter, an intermediate limiter and a lower limiter.

FIG. 8 shows another embodiment of a capacity limiting assembly 800 having three stacked limiters 810, 820, 830 corresponding to three different overall heights from the bottom of limiter assembly 800. Accordingly, detaching the top limiter 830 from the lower limiter 810, or both the top and intermediate limiter 820, 830, from the lower limiter 810, introduces two additional configuration having two predetermined lower cartridge capacities for the same magazine 100. Alternatively, the two additional shortened configurations of limiting assembly 810 can be installed in smaller magazines having shorter magazine bodies (not shown).

Figure 9:
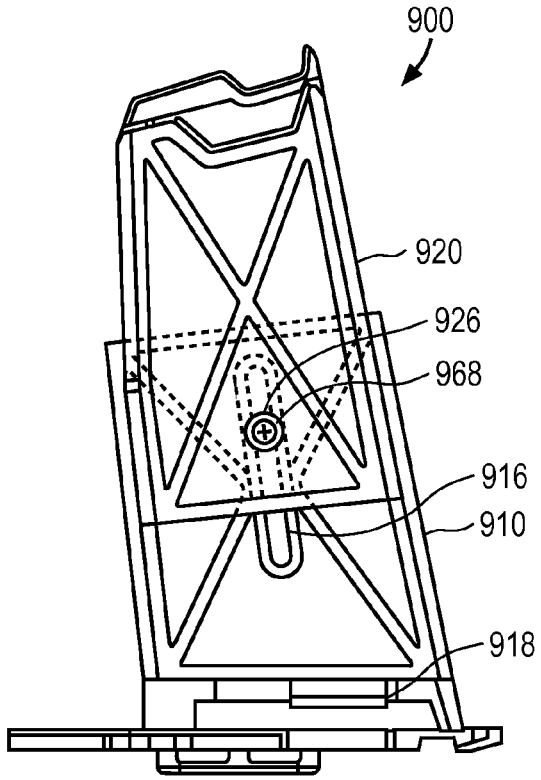
FIG. 9 illustrates yet another embodiment of a capacity limiting assembly having detachable lower and upper limiters, and wherein the overall height of the limiting assembly is adjustable.

FIG. 9 illustrates yet another embodiment of an adjustable capacity limiting assembly 900 wherein the lower and upper limiters 910, 920 include a slot 916 and a hole 926, respectively, configured to accommodate a fastener such as a machine screw 968. In this embodiment, it is possible for lower and upper limiters 910, 920 of limiting assembly 900 to be initially formed as one contiguous structure, with the bottom of the upper limiter 920 joined to the top of lower limiter 910, in a configuration similar to that limiting assembly 200.

Modifications to accommodate different cartridge sizes and/or magazine types are also possible. For example, for larger rifle cartridges, e.g., a 7.62×51 cartridge, the limiter body may be large and hence stable enough to operate reliably without a limiter base.

Suitable materials for constructing the capacity limiting assemblies of the present invention include materials strong enough to prevent deformation while in use, such as, but not limited to thermo moldable plastics, fiberglass impregnated nylon, carbon fiber composites, epoxy compounds, synthetic resins, aluminum alloys and sheet metal. Note that the various components, e.g., limiters, of the described embodiments may be assembled using joints such as dovetail slots and tongue and groove. These joints can be reinforced by the use of adhesives such as plastic cements or epoxy compounds, and/or by employing techniques such as ultrasonic bonding or heat bonding.

The advantages of the present invention include, without limitation, the ability to quickly and economically reduce the capacity of cartridge magazines in production or future production using the existing magazine parts. Complex parts such as the magazine follower, which is critical for reliable function, do not need to be replaced. Spring tension and structure need not be altered. Further the outward shape and appearance of the magazine which can affect handling characteristics is not compromised. In the above described embodiments, magazines cannot be readily converted back to higher capacity without disassembly of the magazine. In some embodiments, the limiting assembly may also be permanently attached to the magazine spring, which prevents reassembly of the magazine in a higher capacity, while allowing for cleaning and maintenance of the magazine.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A magazine capacity limiting assembly configured to limit a cartridge capacity of a firearm magazine having a magazine body, a magazine spring, a cartridge follower and a magazine floor plate, the magazine capacity limiting assembly comprising:

a contiguous magazine capacity limiter body having a top edge configured to operate with a cartridge follower of a firearm magazine, the cartridge follower configured to be operatively coupled to a top of a magazine spring of the firearm magazine, wherein the limiter body is configured to be installed substantially within coils of the magazine spring, and wherein the limiter body is further configured to limit the travel of the magazine follower within the magazine body thereby limiting a cartridge capacity of the firearm magazine;

wherein the contiguous capacity limiter body includes an upper limiter and a lower limiter, and wherein the upper limiter is configured to be irreversibly severable and detachable from the lower limiter, thereby further changing the cartridge capacity of the firearm magazine;

wherein the lower limiter has a vertical height larger than a diameter of a cartridge intended for the firearm magazine, and wherein the lower limiter, when permanently severed from the upper limiter, is configured to limit travel of the cartridge follower thereby numerically limiting the cartridge capacity below a maximum cartridge capacity of the firearms magazine; and wherein the limiter body is further configured to intentionally create a horizontal clearance gap extending contiguously and entirely along the top edge of the limiter body, the clearance gap located between a bottom of the magazine follower and the top edge of the limiter body, thereby enabling the firearm magazine to function reliably with a firearm without changing the cartridge capacity of the firearm magazine and without permitting an extra cartridge to be loaded into the firearm magazine.

2. The limiting assembly of claim 1 further comprising a magazine capacity limiter base configured to be operatively coupled to the magazine limiter body and also configured to be operatively coupled to a magazine floor plate of the firearm magazine.

3. The limiting assembly of claim 1 wherein the upper limiter includes an intermediate limiter.

4. The limiting assembly of claim 1 wherein the capacity limiter body includes at least one structural reinforcement rib.

5. The limiting assembly of claim 1 wherein the capacity limiter body includes at least one protruding magazine spring lock configured to securely couple a bottom of the magazine spring to the limiter body.

6. The limiting assembly of claim 1 further comprising a magazine follower mate configured to be operatively coupled to the top of the limiter body and wherein the follower mate is configured to operate reliably with one or more types of magazine followers while limiting the cartridge capacity of the magazine.

7. The limiting assembly of claim 1 further comprising a plate lock configured to operatively couple a limiter base to the magazine floor plate.

8. The limiting assembly of claim 1 wherein the capacity limiter body includes at least one cartridge capacity indicator.

9. A firearm magazine reconfigured by a magazine capacity limiting assembly, the firearm magazine comprising:

a magazine body;

a cartridge follower configured travel within the magazine body;

a magazine spring, wherein a top of the magazine spring is configured to be coupled to the bottom of the magazine follower;

a magazine floor plate configured to secure the magazine spring inside the magazine body; and a magazine capacity limiting assembly configured to limit a cartridge capacity of the firearm magazine, the limiting assembly including:

a contiguous magazine capacity limiter body having a top edge configured to operate with the cartridge follower, wherein the limiter body is configured to be installed substantially within coils of the magazine spring, and wherein the limiter body is further configured to limit the travel of the magazine follower within the magazine body thereby limiting the cartridge capacity;

wherein the contiguous capacity limiter body includes an upper limiter and a lower limiter, and wherein the upper limiter is configured to be irreversibly severable and detachable from the lower limiter, thereby further changing the cartridge capacity of the firearm magazine;

wherein the lower limiter has a vertical height larger than a diameter of a cartridge intended for the firearm magazine, and wherein the lower limiter, when permanently severed from the upper limiter, is configured to limit travel of the cartridge follower thereby numerically limiting the cartridge capacity below a maximum cartridge capacity of the firearms magazine; and wherein the limiter body is further configured to intentionally create a horizontal clearance gap extending contiguously and entirely along the top edge of the limiter body, the clearance gap located between a bottom of the magazine follower and the top edge of the limiter body, thereby enabling the firearm magazine to function reliably with a firearm without changing the cartridge capacity of the firearm magazine and without permitting an extra cartridge to be loaded into the firearm magazine.

10. The firearm magazine of claim 9 wherein the capacity limiter body further comprising a magazine capacity limiter base configured to be operatively coupled to the magazine limiter body and also configured to be operatively coupled to the magazine floor plate.

11. The firearm magazine of claim 9 wherein the capacity limiter body includes at least one protruding magazine spring lock configured to securely couple a bottom of the magazine spring to the limiter body.

12. The firearms magazine of claim 9 wherein the upper limiter includes an intermediate limiter.

13. The firearms magazine of claim 9 wherein the capacity limiter body includes at least one structural reinforcement rib.

14. The firearms magazine of claim 9 wherein the limiting assembly further comprising a magazine follower mate configured to be operatively coupled to the top of the limiter body and wherein the follower mate is configured to operate reliably with one or more types of magazine followers while limiting the cartridge capacity of the magazine.

15. The firearms magazine of claim 9 further comprising a locking mechanism configured to permanently attach the magazine capacity limiting assembly to the magazine body, thereby resulting in a permanent reduction in the magazine capacity of the firearms magazine intended to comply with applicable laws, regulations and ordinances.

* * * * *